United States Patent [19]

Hall et al.

[11] 4,086,971

[45] May 2, 1978

[54] RISER PIPE INSERTS

[75] Inventors: Johnce E. Hall, Broken Arrow; William D. Greenfield, Tulsa, both of Okla.

[73] Assignee: Standard Oil Company (Indiana), Chicago, Ill.

[21] Appl. No.: 723,400

[22] Filed: Sep. 15, 1976

[51] Int. Cl.[2] ..... E21B 15/02

[52] U.S. Cl. ..... 175/7; 9/8 R; 166/242

[58] Field of Search ..... 9/8 R, 8 P; 114/264, 114/265; 166/.5, .6, 242; 175/5, 7, 65, 67; 138/45, 46, 137, 140, 148; 61/86

[56] References Cited

U.S. PATENT DOCUMENTS

| | | | |
|---|---|---|---|
| 2,607,422 | 8/1952 | Parks et al. | 166/.5 |
| 3,729,756 | 5/1973 | Cook et al. | 9/8 R |
| 3,958,640 | 5/1976 | Daniels | 175/65 |

*Primary Examiner*—Trygve M. Blix

*Assistant Examiner*—Charles E. Frankfort

*Attorney, Agent, or Firm*—John D. Gassett

[57] ABSTRACT

The riser pipe, e.g., 21 inches in diameter, extends from the ship to an anchored wellhead assembly on the ocean floor. A drill bit and drill string are guided down through the inside of the riser pipe and the anchored wellhead assembly to perform drilling operations in the ocean floor. Various strings of casing for lining the borehole wall, which is thus drilled, are run down through the interior of the riser pipe. The first string of casing run is of relatively large diameter, e.g., 20 inches in diameter followed by 13⅜ or 10¾ strings. Intermediate strings are typically 9⅝ or 7⅝, depending on the previous string diameters. As heavier drilling muds are used, the riser tension needed to prevent buckling is increased. To reduce the tension required, we place a sleeve of low density in the annulus between the drill string and the riser pipe interior wall, leaving a much smaller annulus between the drill pipe and the insert, thus displacing the heavier mud with a lighter weight insert.

6 Claims, 11 Drawing Figures

TABLE I

REPRESENTATIVE EFFECTS OF "FOAM" INSERT

| 21" ϕ x 0.5" t RISER USING 9 5/8" ϕ x 0.312" t CASING TUBING AS INSERT WEAR LINER | | | | | |
|---|---|---|---|---|---|
| $\rho_{MUD}$ | W | $W_I$ | ΔW | %ΔW | $D_e$ |
| 10 | 118.6 | 79.3 | 39.3 | 33.1 | 26 |
| 12.5 | 159.4 | 91.5 | 67.9 | 42.6 | 29 |
| 18 | 249.2 | 118.5 | 130.7 | 52.5 | 34 |

| 21" ϕ x 0.5" t RISER USING 10 3/4" ϕ x 0.279" t CASING TUBING AS INSERT WEAR LINER | | | | | |
|---|---|---|---|---|---|
| $\rho_{MUD}$ | W | $W_I$ | ΔW | %ΔW | $D_e$ |
| 10 | 118.6 | 85.0 | 33.6 | 28.3 | 25 |
| 12.5 | 159.4 | 99.6 | 59.8 | 37.5 | 28 |
| 18 | 249.2 | 131.7 | 117.5 | 47.2 | 33 |

$\rho_{MUD}$ ≡ DENSITY OF MUD (LBS/GAL.)
W ≡ BUOYANT WEIGHT OF RISER W/O INSERT (LBS./FT.)
$W_I$ ≡ BUOYANT WEIGHT OF RISER W/ INSERT (LBS/FT.)
ΔW ≡ WEIGHT REDUCTION BY INSERT (LBS/FT)
%ΔW ≡ PERCENT REDUCTION IN BUOYANT WEIGHT (%)
$D_e$ ≡ EQUIVALENT AMOUNT (DIA.) OF EXTERIOR FLOTATION FOAM TO REPLACE INSERT (IN.)
ϕ ≡ DENOTES OUTSIDE DIAMETER
t ≡ DENOTES WALL THICKNESS
OTHER PARAMETERS:
$\rho_{FOAM}$ = 30 LBS/CU. FT.
RADIAL GAP BETWEEN FOAM INSERT AND RISER = 1/2"

FIG. 7

TABLE 2

REPRESENTATIVE EFFECTS OF "PACKED-OFF" INSERT

| 21" ϕ x 0.5" t RISER PACKED-OFF WITH 13 3/8" ϕ x 0.330" t CASING AND INSERT ANNULUS GAS FILLED | | | | | |
|---|---|---|---|---|---|
| $\rho_{MUD}$ | W | $W_I$ | ΔW | %ΔW | $D_e$ |
| 10 | 118.6 | 83.2 | 35.4 | 29.8 | 26 |
| 12.5 | 159.4 | 103.6 | 55.8 | 35.0 | 28 |
| 18 | 249.2 | 148.7 | 100.5 | 40.3 | 32 |

$\rho_{MUD}$ ≡ DENSITY OF MUD (LBS./GAL.)

W ≡ BUOYANT WEIGHT OF RISER W/O INSERT (LBS./FT.)

$W_I$ ≡ BUOYANT WEIGHT OF RISER W/ INSERT (LBS./FT.)

ΔW ≡ WEIGHT REDUCTION BY INSERT (LBS/FT)

%ΔW ≡ PERCENT REDUCTION IN BUOYANT WEIGHT (%)

$D_e$ ≡ EQUIVALENT AMOUNT (DIA.) OF EXTERIOR FLOTATION FOAM TO REPLACE INSERT (IN.)

ϕ ≡ DENOTES OUTSIDE DIAMETER t ≡ DENOTES WALL THICKNESS

OTHER PARAMETERS:

$\rho_{FOAM}$ 30 LBS/CU. FT. (EXTERIOR)

FIG. 11

RISER PIPE INSERTS

BACKGROUND OF THE INVENTION

1. Field of the Invention

This invention relates to drilling in earth formations located beneath a body of water, such as in the Gulf of Mexico, and in which the drilling operations are conducted from a floating vessel. More specifically, this invention relates to a method and apparatus involving a riser pipe which extends from the ocean floor to a floating vessel located at the surface of the body of water. It relates especially to a novel riser pipe in which there are means to change the effective size of the riser and reduce the amount of tension needed to be applied to the riser pipe.

2. Setting of the Invention

In recent years, it has become desirable to use a floating vessel from which to drill wells in a marine location. In such operations, the floating vessel is sometimes connected to a submerged wellbore by a long tubular member through which drilling tools, drilling fluids, etc., pass between the vessel and the wellbore. This long tubular member is commonly referred to as a riser pipe. The vessel is maintained on location normally by long cables which are connected to anchors in the ocean floor. Alternatively, dynamic positioning units can be provided from the vessel.

The submerged wellhead usually includes a blowout preventer and other control equipment. In one embodiment, the upper part of the wellhead assembly includes a ball connector which provides a flexible connection between the wellhead assembly and the riser pipe. The lower end of the riser pipe is connected to this ball joint and is free to pivot thereabout. This is commonly called a flex joint. Other types of flex joints are commercially available; however the ball and socket joint is enjoying high popularity. Although a vessel is anchored, it can have vertical movement of from a few feet up to 25–30 feet or more. To compensate for this vertical movement, a slip or telescopic joint is provided in the riser pipe. The slip joint is usually located at the top of the riser pipe to avoid the need for high pressure seals and so that it can be serviced more easily than if it were placed on the bottom.

If the riser pipe is supported solely at its lower end, its only effective weight, i.e., weight in water, causes it to be in a state of axial compression increasing from 0 at the top to a maximum at the bottom support. A drilling fluid is normally circulated down the drill string within the riser pipe and back up to the surface in the space between the riser pipe and external wall of the drill string. The weight of this drilling fluid may vary from about 8½ lbs/gal up to about 13, 15 or more lbs/gal. The weight of the drilling mud also has a degrading effect on column stability (buckling) of the riser pipe. To counteract this buckling effect, it has become a practice to apply a tensile force to the top of the riser pipe. Special tensioning devices are mounted on the ship and have their cables attached to the upper end of the riser pipe but below the slip joint. These tensioning devices are commonly referred to as constant tensioning devices so that they can maintain a constant tension on the riser pipe, although the ship may rise and fall with respect to the riser pipe. These constant tensioning systems are helpful but are costly and must be maintained, maintenance requirements being proportionate to tension output. In order to reduce the tension which must be applied to the top of the riser pipe, it has been suggested that a flotation assembly be added to the exterior of the riser pipe. For example, some assemblies include a premolded foam core that is bonded directly to the outer wall of the pipe and is completely exposed about its outer surface to the water in which it is immersed.

2. Prior Art

The closest prior art of which we are aware is U.S. Pat. No. 3,729,756, issued May 1, 1972, entitled "Flotation Assembly". This patent describes a collar to be placed around the riser pipe and comprises a pair of semiannular flotation members, each of which includes a semicircle outer shell of fiberglass, a semiannular low density core preferably including a plurality of plastic hollow spheres surrounded by synthetic foam, and arcuately shaped clamping means imbedded in the core. We know of no art which teaches to modify the interior of the riser pipe to reduce the required tension in the manner as taught herein.

RELATED APPLICATION

This application is related to U.S. Patent Application Ser. No. 723,397, entitled Marine Riser Insert Sleeves, filed Sept. 15, 1976, an application of Michael R. Waller.

BRIEF DESCRIPTION OF THE INVENTION

This invention concerns a marine riser pipe for connection between a subsea wellhead and a floating vessel and through which drilling operations are conducted. Drilling operations are then conducted through the riser pipe until a sufficient depth of hole is drilled so that it is desirable to set a string of casing. A string of casing, which may be the surface casing, for example, is run through the riser pipe and is the largest string run through the riser pipe, of course, because subsequent strings of casing must be run through the previously set surface casing string. As soon as the large string of casing has been run, it would be desirable to have a smaller riser pipe. However it is rather impractical to pull the first riser pipe and run a new and smaller riser. We, therefore, run a sleeve inside the riser, which is made of a material which has an effective density less than sea water, although any material having a density less than that of the drilling mud is helpful. The internal diameter of the insert is approximately the same as the internal diameter of the casing just set. Fewer tensioning devices or lower tension settings are needed than without inserts. An alternative is an insert casing packed off top and bottom against the riser with mud displaced from the sealed annulus by gas pressure.

DRAWINGS

A better understanding of the invention may be had from the following detailed description taken in conjunction with the drawings:

FIG. 7 is a table showing representative effects of using a sleeve in a riser pipe in accordance with our invention;

FIG. 11 is a table showing representative effects of using a casing insert illustrated in FIG. 6.

DETAILED DESCRIPTION OF THE INVENTION

Figure 1:
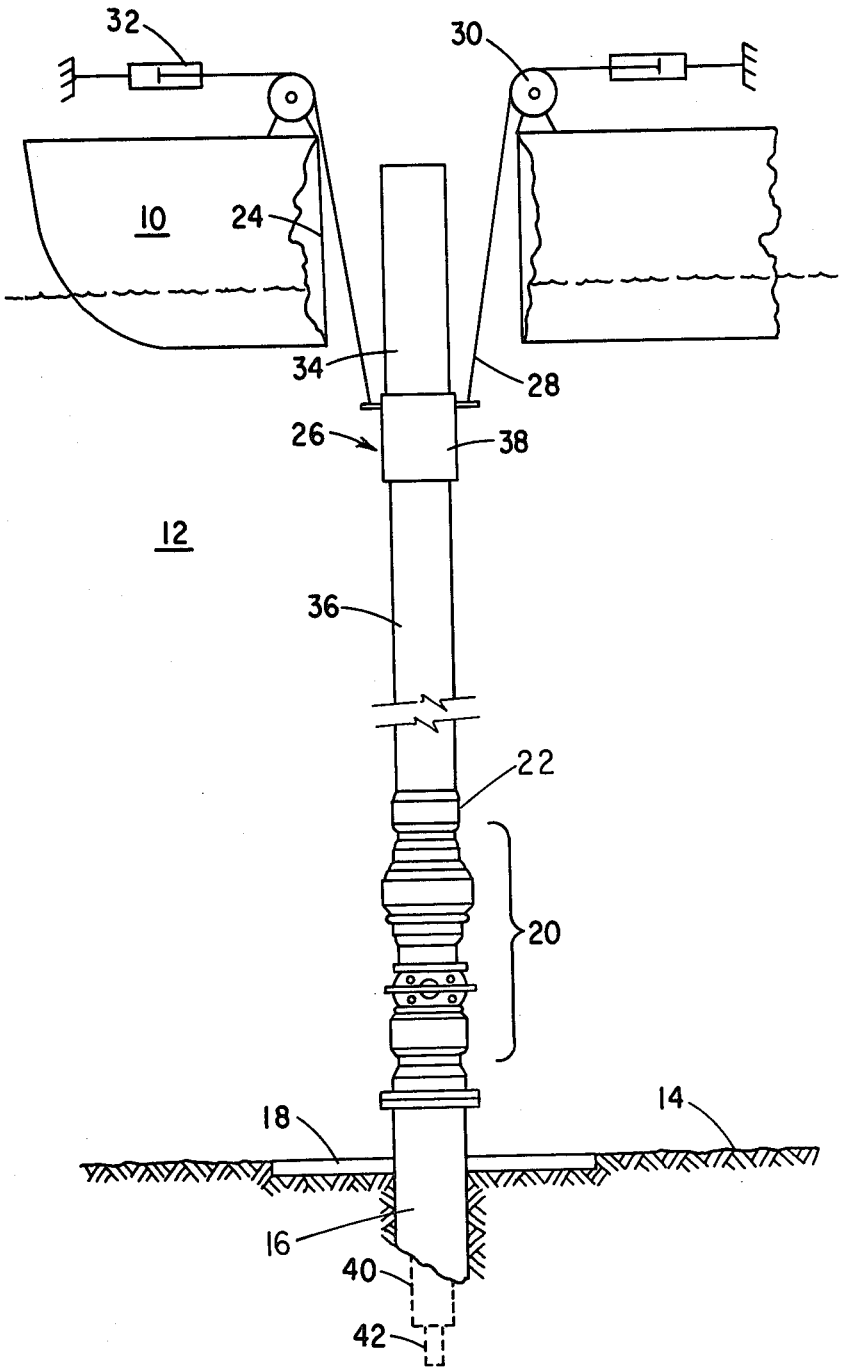
FIG. 1 illustrates a drilling vessel with a conventional riser pipe.

Attention is first directed to FIG. 1 which shows a conventional riser pipe extending from a ship 10 to wellhead assembly 20. The ship is supported by a body of water 12 having a bottom 14. Vessel 10 is anchored by means not shown above the well in the ocean floor which is cased with casing 16, for example. Casing 16 is attached to a pad or other anchor means 18. Casing pad 18 can be cemented or otherwise secured to the ocean floor so that in effect it may form an anchor. Mounted at the top of casing 16 is the wellhead assembly 20 which includes blowout preventers. Mounted on the upper end of the wellhead assembly 20 is the lower portion of the ball and socket joint 22 which mates with the lower end of the riser pipe assembly 26.

Vessel 10 has a well or moonpool 24 in which is suspended riser pipe assembly 26 by cables 28. Cables 28 extend over sheave 30 to a tensioning means 32 which is supported by the vessel. Riser pipe assembly 26 includes an upper section 34 and a lower riser pipe section 36. A slip joint 38 is provided. Thus, cables 28 are effectively connected to the lower section 36 so that tension can be applied to it by tensioning means 32.

Typical diameters of riser pipe section 36 are 21 inches or 18⅝ inches. In drilling the well with the system of FIG. 1, after a first selected depth is obtained, a string of casing is run. This casing string is indicated by dotted lines 40 and typically can be a 20 inch casing string which may be set for 500 to 1000 feet in the ground. If additional hole is drilled after the casing 40 is set, an additional casing string indicated at 42 is set at approximately 2500 to 3500 feet using typically 9½ to 10 lb/gal mud. Typically this can be 13⅜ or 10¾ inch casing. Casing strings 40 and 42 are hung off at the mudline in a known manner. Depending on the well program, further drilling may require intermediate casing strings, typically of 9⅝, 7⅝ or 7 inch casing, when heavier mud weights, typically 12½ lb/gal, are reached.

The mud weight (that is, the density or pounds per gallon of the circulating drilling fluid), riser pipe diameter, and riser pipe length are three influential parameters which dictate the riser tensioning requirements needed at tensioning means 32 on the drilling vessel. The heavier the drilling mud, the greater the tension required, etc. Clearly the mud weight and the riser length are determined by drilling site conditions. This leaves the diametrical variable as a weight controlling parameter when water depths exceed the mechanical capacity of the tensioning system. After the second string of casing 42 is set, one could remove riser pipe assembly 26 and replace it with a second riser pipe assembly having the same inside diameter as casing 42. However, this is rather impractical. Historically, drilling operations in water depths beyond the tensioning capabilities have been accomplished by attaching an exterior flotation module to the outside of the riser pipe itself. This practice is expected, however, to reach operational limits as, for example:

1. The larger diameters created by the exterior flotation modules increase the riser's hydrodynamic inertia and drag components. This can lead to undesirable dynamic responses of the riser system.

2. Higher drag forces on the riser place a greater burden on the drilling vessel station keeping, which limits the amount of current that can be tolerated.

3. It is possible in very deep water operations that the exterior flotation scheme could lead to a positively buoyant riser, thus creating a very dangerous situation.

By contrast, the system which we suggest of using inserts, described in greater detail hereinafter, eliminates many of these problem areas or at least reduces their significance. Generally speaking, after casing 42 is set, we run a riser insert made up of several insert sections 47 inside riser pipe section 36. Drilling operations are then conducted through such sleeve insert section 47 and the riser pipe section. As shown above, the size of this sleeve insert typically can be 10¾ in. or 13⅜ in., which is essentially the same as the inside diameter of a typical casing 42 as indicated above. It is through this 10¾ in. or 13⅜ in., as the case may be, next casing insert 47 is run and through which the next set of drilling operations are conducted. Typically, a drill pipe is 4½ in. or 5 in. O.D. although some are smaller. The most common size is 4½ in. O.D. Thus, when the first insert 47 is run, typically, the drill pipe has a diameter of 4½ in. and the insert 47, an internal diameter of about 10 in. Riser pipe section 36 has a diameter of about 21 in. These general proportionate sizes are more clearly indicated in FIG. 8, which demonstrates drill pipe 35 and insert section wear liner 48. At this point in the operations, drilling fluid is circulated down the drill pipe 35 through the bit pipe, not shown, in a conventional manner and back up the annulus, which is that part of the interior of riser pipe section 36 not occupied by insert 47. This path through the annulus would be essentially the annulus between the interior wall of liner 48 of section 47 and the exterior wall of drill pipe 35.

Figure 2:
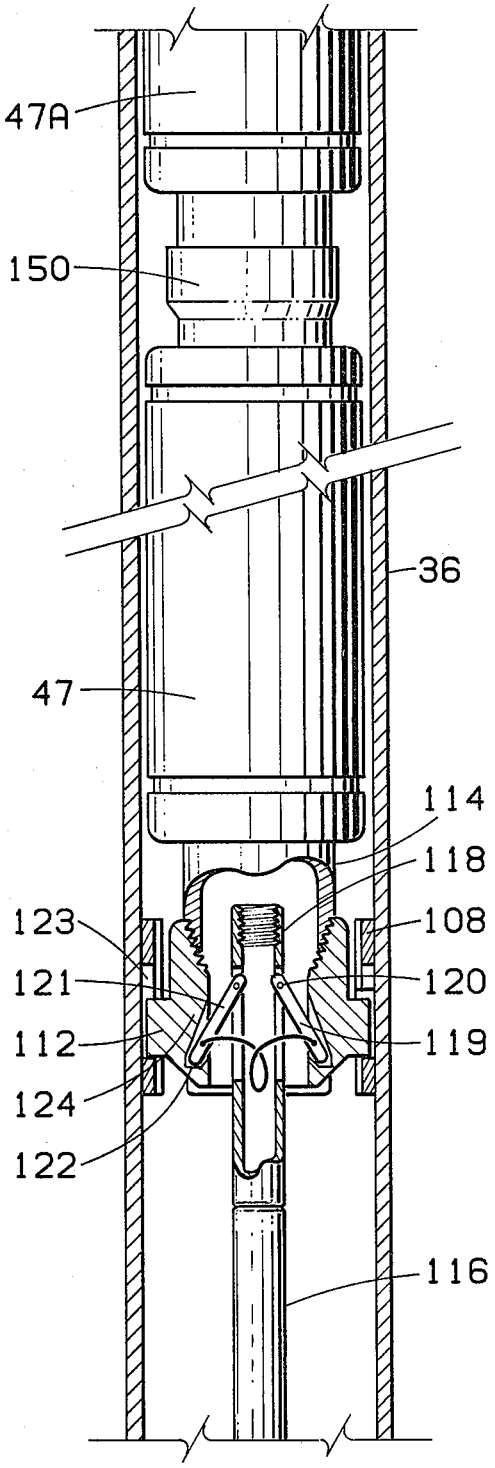
FIG. 2 illustrates a latching means for holding the insert in position and also illustrates a weight used for pulling the insert down.
Figure 3:
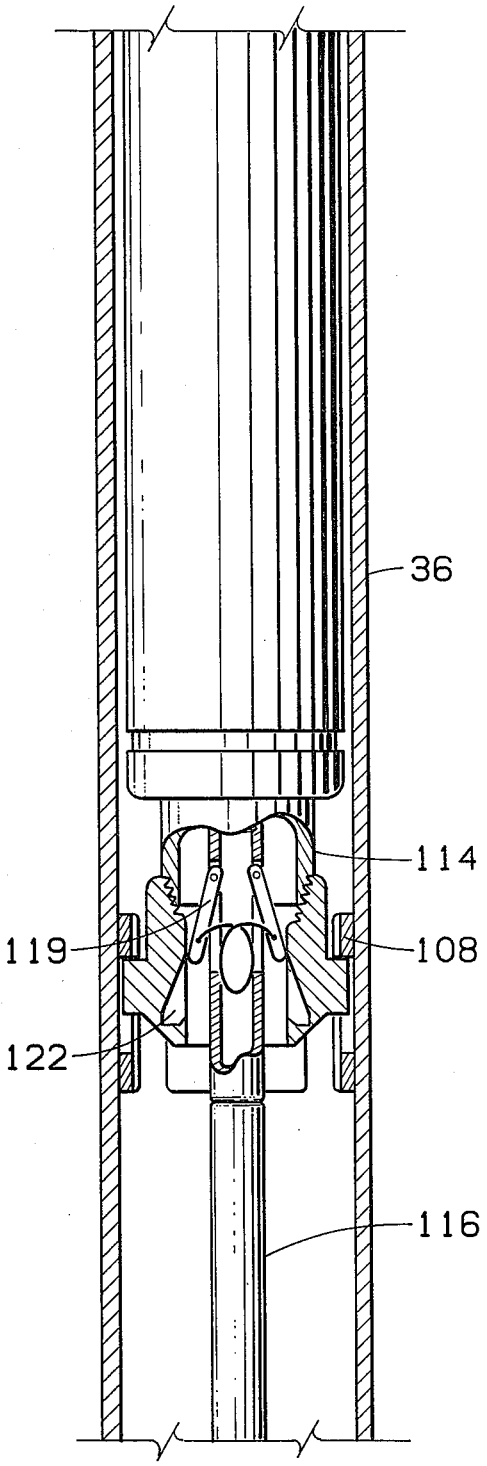
FIG. 3 is similar to FIG. 2, except that the device is in a position showing that the weight is being removed from the hole while the latching mechanism remains in the riser pipe.

Attention is thus directed to FIGS. 2, 3, 4 and 5 to show what may be considered a preferred embodiment of our insert system. FIGS. 2, 3, 4 and 5 are not drawn to scale, but are merely intended to illustrate means of holding the lightweight insert 47 in place. Shown in FIGS. 2 and 3 is a riser pipe 26. The insert as shown is made up of several insert sections 47 and 47A which have an inner thin wall wear liner 48 which may be steel and a rather large annular portion 50 which is some lightweight foam material. There are syntatic and composite flotation materials which are commmercially available and which can withstand hydrostatic pressures upwardly to 15,000 psi which is approximately 16,000 ft of 18 lbs/gal mud. Such flotation materials are commercailly available, for example, from Emerson &

Cuming, Inc. Normally, the inside diameter of liner 48 is the same as the inside diameter of the last casing run and through which drilling operations are to be continued. In fact, standard sizes in casing tubing can be used effectively as a wear liner. (Straps 59 are provided about the outer wall of the inserts)

Attention is now directed to FIGS. 2 and 3 for means of holding the lightweight insert in the riser pipe. At a depth or location along the riser 26 at which it is desired to have the bottom of the inserts, there is provided a modified "J" slot arrangement 108. This can be quite similar to the locking slot arrangement 130 shown in FIGS. 9 and 10. A locking spider 124 is provided at the lower end of the insert 47 and is provided with four lugs 112, which are 90° apart and can be similar to the locking lugs 132 shown in FIGS. 9 and 10. The locking spider 124 is connected to flotation unit 47 by pipe means 114.

Means will now be discussed as to methods for holding weight 116 to pull the insert 47 down and also means for removing the weight 116. This includes pipe 118 hung inside insert liner 114 and extends downwardly through the spider arm 124. Outwardly biased arms 119, pivoted about pivot 120 on pipe 118, are provided so that when they reach cavity 121 within spider 110 they will expand and engage the lower shoulder 122 of cavity 121. At this point the downward force of the weight of weight bar 116 is applied through spider 124 to insert 47, pulling it down. The tool advances downwardly until it reaches the lock 108 at which time proper rotation and lowering of the spider 124 causes the arms or lugs 112 to fit into latching space 123. Then the weight pulls the lugs 112 down to the shoulder 124 of the locking slot.

Once the spider 124 is latched into position, bar 116 can be removed. Pipe 118 is run through the inserts and then latched onto the sub assembly as indicated in FIG. 3. Pulling up on pipe string 118 causes the arms 119 to contract into the position shown in FIG. 3. Continued upward pulling on the pipe 118 removes weight 116. Insert 47 is secured to the next higher insert 47A by joint 150 which can be similar to joints used for connecting different sections of drill pipe.

Figure 4:
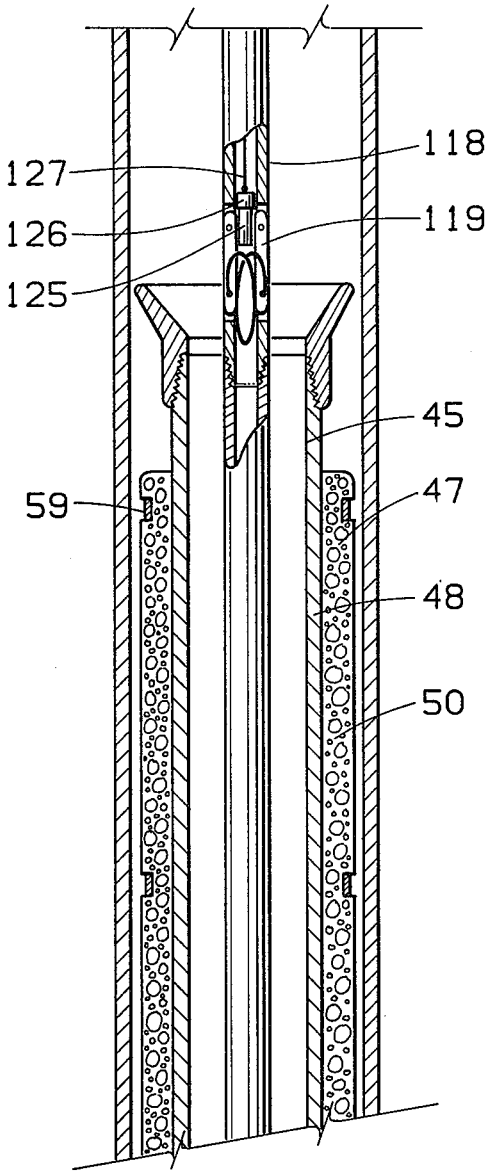
FIG. 4 shows the weighted bar lowering tool entering the top of the center passage of the low density insert with the engaging arms held in a retracted position.
Figure 5:
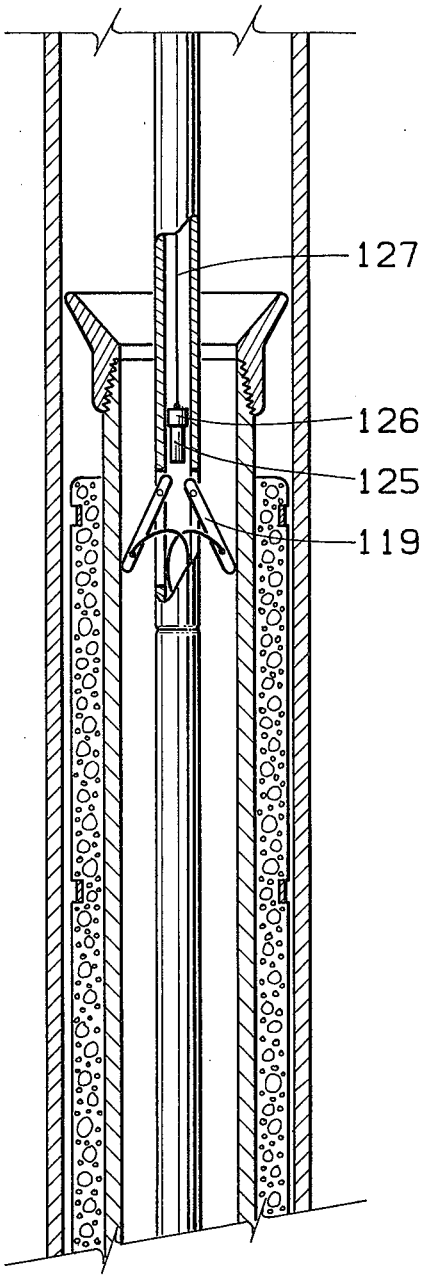
FIG. 5 is similar to FIG. 4 except the means for holding the engaging arms in a retracted position have been withdrawn.

Attention is next directed to FIGS. 4 and 5 to illustrate a way of lowering the pipe string 118 and arms 119 through the interior of the insert 47. All that is necessary to do is to keep arms 119 in their retracted position. This is easily accomplished by providing a plug 125 with head 126 on string or line 127. If it were not for plug 125, arms 119 would be expanded and could not enter in through the upper end of passage 45 of insert 47. As shown in FIG. 5, once the arms 119 are in passage 45, plug 125 is pulled up and the arms 119 are biased outwardly. Continued lowering of the pipe 118 until it reaches the position shown in FIG. 2 will let the arms at that time expand out into cavity 121.

Figure 9:
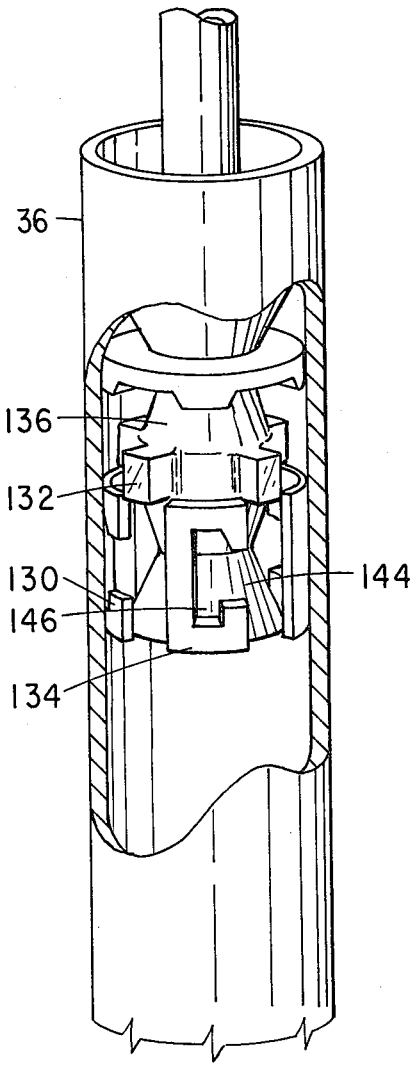
FIG. 9 illustrates a broach inhibitor arrangement to be inserted in the top of the riser pipe above the foam insert as a safety measure to keep it from moving upwardly in the event the lower latching means fails.
Figure 10:
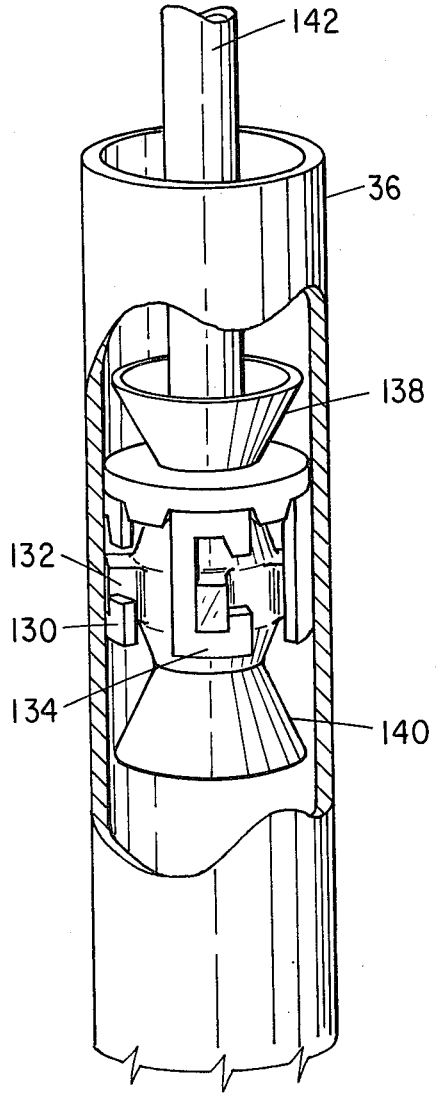
FIG. 10 is similar to FIG. 9, except that the broach inhibitor is in its lower position inside what may be called J slots.

FIGS. 2 and 3 show latching means for holding the insert 47 in position. These locking mechanisms are all at the lower end of the insert. It is doubted that these locking mechanisms would ever fail. However, as a safety measure, it would be well to have a back-up mechanism to prevent the insert 47 from "jetting" to the surface. One such secondary safety means is shown in FIGS. 9 and 10. These can be called broach inhibitors and, as shown in FIGS. 9 and 10, a modified locking "J" slot 130 is provided in the upper end of the riser pipe 26, which will be above the space where the inserts 47 are located. Item 130 will be secured to riser 26 during fabrication. The internal diameter of the slot arrangement 130 is such as to permit the passage of the largest casing to be run through the riser 26 and also to permit the passage of inserts 47. FIG. 9 shows what may be called a series of C-slots 134 inasmuch as they resemble a C more than they do a J. There would ordinarily be four of the C-slot arrangements 134 equally spaced about the interior of riser pipe 26. All of the C-slots 134 are welded or otherwise secured to the inside of riser pipe 26. The spider arm 136 with lugs 132, of course, is not. It is provided with an upper funnel 138 and a lower funnel 140 and is run on a string of pipe 142. Spider 136 is lowered until it reaches the level of opening 144 of C-slot 134. At this time the device is rotated so that lugs 132 fit into the receiving slot 146 of C-slot 134. This is shown in FIG. 10. Funnels 138 and 140 permit the running of various tools through the broach inhibitor shown in FIGS. 9 and 10, but are sufficiently small in diameter so as to stop the upward movement of insert 47, should the lower latching means fail.

An important function of sleeve 47 is to replace the heavier mud column in the excess portion of the riser tube in which the sleeve is located with a lightweight foam material. In reality, the riser need be only no bigger in diameter than the interior of sleeve 47 which is the same size as the just previous casing string. By placing the foam sleeve within the riser pipe, a substantial decrease in overall riser weight is realized. For example, as shown in FIG. 7, the weight per unit length of a 21 inch O.D. riser, filled with an 18 lb/gal mud, can be reduced to approximately 131 lbs/ft using the $9\frac{5}{8}$ inch insert. This represents a 52% reduction in buoyant weight, or expressed in the terms of hardware, this weight saving represents an 82% effort of two 80 kip pneumatic tensioning devices for each 1,000 ft of riser in use. The effects of using a $9\frac{5}{8}$ inch insert which is normally set at $12\frac{1}{2}$ #/gal mud and $10\frac{3}{4}$ inch insert which is typically set at 10 #/gal mud in a 21 inch riser system are summarized in FIG. 7 for various representative mud weights. An examination of the table in FIG. 7 shows that the percentage of weight reduction by using the inserts in from 28–52%. These are, indeed, clearly major improvements.

Figure 8:
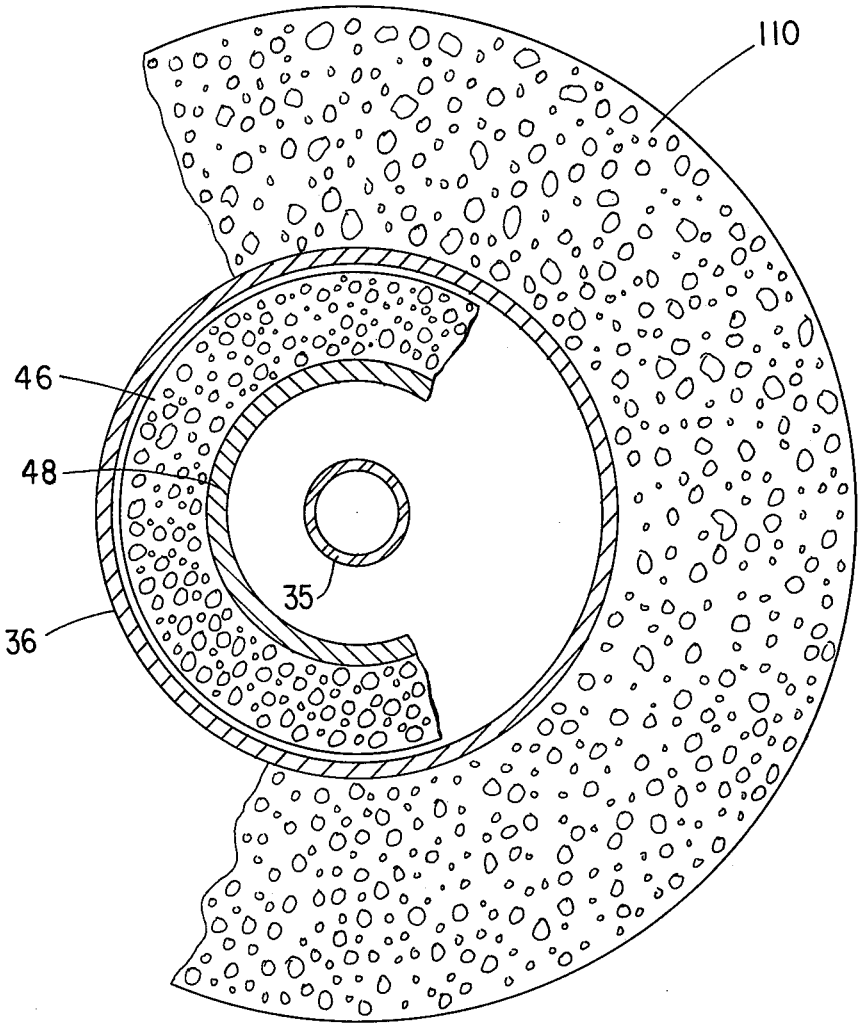
FIG. 8 is a horizontal cross-section comparison of the size of an exterior flotation unit to be equivalent to a given foam insert.

Attention is directed to FIG. 8 which illustrates the amount of exterior flotation foam 110 which would be necessary to be equivalent insofar as reducing tension required on riser 26 if it were provided with an interior foam insert 46. In this particular illustration, the drilling mud has the weight of 18 lbs/gal, drill pipe 112 has an exterior diameter of 5 inches, riser pipe 26 has an outside diameter of 21 inches and is $\frac{1}{2}$ inch thick and the foam insert 46 has an outside diameter of 19 and an inside diameter of 9 inches. To obtain the equivalent amount of exterior flotation foam to replace insert 46 would require an exterior flotation foam of 34 inches external diameter assuming the same density of foam. The effect is much more dramatic for larger diameter risers. For example, a similar analogy for a 24 inch riser requires 41 inch external diameter flotation.

Although the $9\frac{5}{8}$ inch insert offers the greatest weight savings in Table 1, it has the disadvantage of occurring late in the well program, whereas the $10\frac{3}{4}$ inch casing can be set in the early stages of the well. There is a slight disadvantage in using the $10\frac{3}{4}$ inch casings instead of the $13\frac{3}{8}$ inch in that the $10\frac{3}{4}$ inch disallows the usage of the popular $9\frac{5}{8}$ inch intermediate casing size, thus forcing casings of smaller diameter earlier in the drilling program. Unfortunately, the $13\frac{3}{8}$ inch "foam" insert is not overly effective in typical riser pipe sizes other than the 24 inch riser. However, the 13⅜ inch "packed-off" insert, described in detail next, does offer advantages in most typical riser pipe sizes, including the 21 inch riser as noted in Table 2 of FIG. 11.

Figure 6:
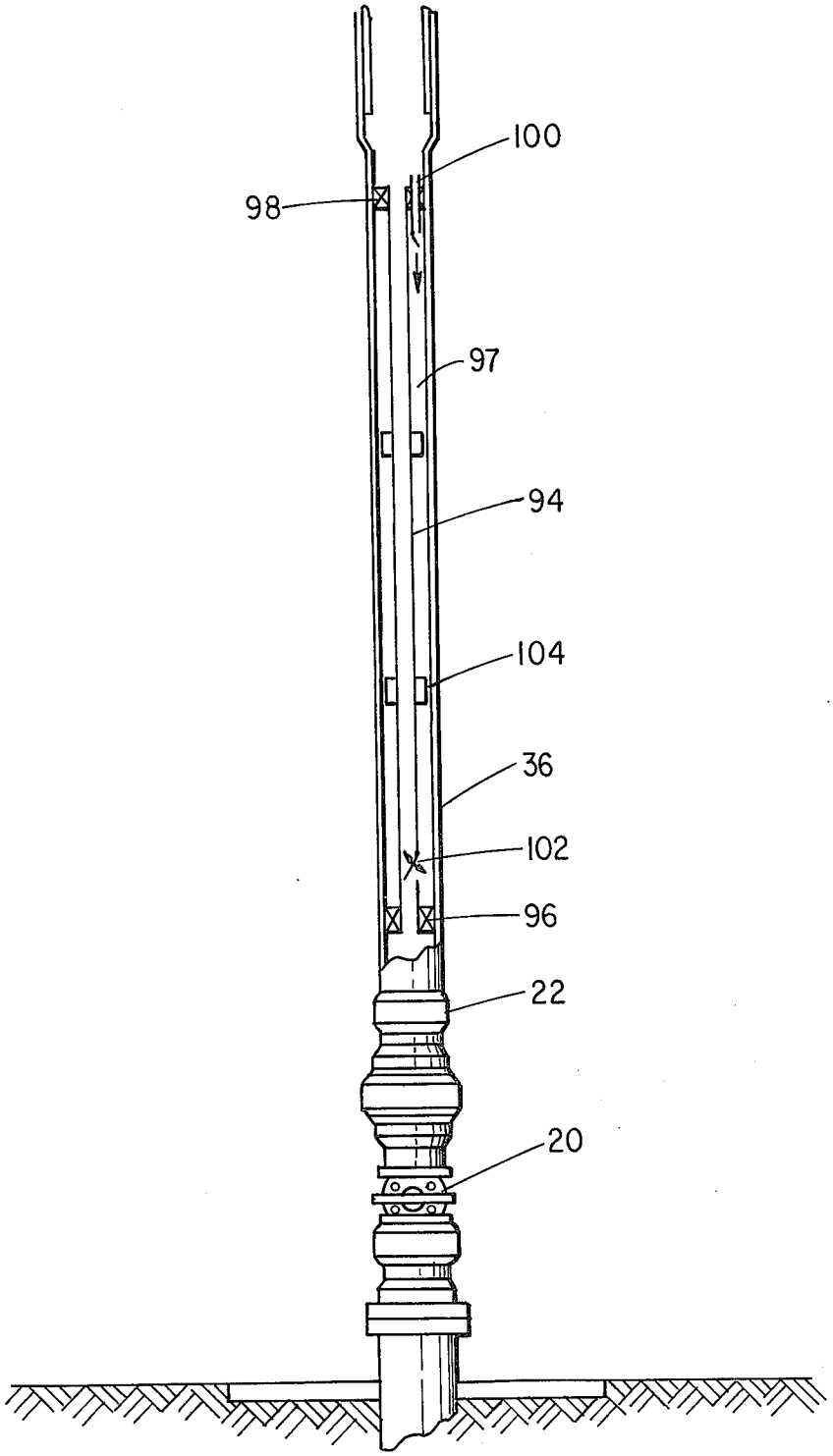
FIG. 6 illustrates a casing insert in a riser pipe and sealed at the top and bottom with the riser.

Attention is next directed to FIG. 6 for an alternative in which an insert casing is packed off or sealed at top and bottom against the riser with mud displaced in the sealed annulus by air pressure. Inside riser 26 is an intermediate casing insert 94. Typically this insert casing 94 would be 13⅜ inches if the second string of casing run was also that size. A bottom seal 96 and a top seal 98 are provided to seal the annular space between the casing insert 94 and the interior of the riser pipe 26. Annulus seals such as 96 and top hanging seal 98 are well known and commercially available. Top hanger in seal 98 has been modified to provide for an air passage 100 therethrough. A check valve 102 has been provided in the insert casing 94 at the lower end just above bottom seal 96. Bumper collars 104 are provided on the exterior of insert 94 as needed. Seals 96, of course, are not set until the device has been lowered to its lower position as shown in FIG. 11. The weight of casing insert 94 will force it down. There is now heavy drilling fluid in the annulus 97 between the exterior of casing insert 94 and the inside of the riser pipe 26. Once the bottom seal 96 is set and the upper seal 98 is also set, air under pressure is injected through conduit 100 at the top of the annulus space to force the heavy drilling mud through check valve 102 until the annulus has been evacuated of heavy drilling mud. The main advantage of the device shown in FIG. 6 is that it offers a greater weight savings in comparison to the "foam" insert method. Furthermore, drilling crews are already familiar with this type equipment and are proficient in its use. Care has to be exercised to be sure that the air pressure is maintained in the annulus space. If not, problems could arise such as riser tube implosion or riser failure due to insufficient tension.

While the above has been described in detail, various modifications can be made thereto without departing from the spirit or scope of the invention.

We claim:

1. An apparatus, for use with a drilling vessel floating on a body of water, in which a drilling mud is circulated which comprises:

a riser pipe connected between said drilling vessel and a subsea wellhead;

a sleeve insert in said riser pipe, the density of said sleeve insert being not greater than that of said water supporting said vessel; and means for holding said sleeve insert in place.

2. A method of operating from an offshore floating drilling vessel floating on a body of water above a subsea wellhead which comprises:

connecting a riser pipe between said floating drilling vessel and said wellhead;

drilling a hole beneath said wellhead using a drilling fluid by operations conducted through said riser pipe and said wellhead;

running a first string of casing through said riser pipe and setting it in said hole;

running a low-density casing sleeve insert in said riser, the density being less than that of said body of water;

securing said sleeve insert in place in said riser pipe; and continuing drilling operations through said casing sleeve insert in said wellboard and said first string of casing.

3. A method as defined in claim 2, including setting a broach inhibitor in said riser pipe above said insert after said sleeve insert is inserted in said riser pipe.

4. An apparatus, for use with a drilling vessel floating on a body of water, in a rotary operation in which a drilling mud is circulated which comprises:

a riser pipe connected between said drilling vessel and a subsea wellhead;

a casing insert within said riser pipe, forming an annulus between said riser pipe and said casing insert;

first means to seal the lower end and second means to seal the upper end of said annulus;

means to displace fluid from said annulus.

5. An apparatus as defined in claim 4 in which said means to displace fluid includes a check valve in the lower end of said annulus permitting flow from within said annulus to the interior of said casing insert;

a conduit extending into the upper end of said annulus below said upper seal for injecting a gas into the upper end of said annulus.

6. A method of operating from an offshore floating drilling vessel and a subsea wellhead which comprises:

connecting a riser pipe between said floating drilling vessel and said wellhead;

drilling a hole beneath said wellhead using a drilling fluid by operations conducted through said riser pipe and said wellhead;

running a first string of casing through said riser pipe and setting it in said hole;

running a casing sleeve insert in said riser forming an annulus between the interior of said riser pipe and the exterior of said casing sleeve;

sealing off the annulus between said casing sleeve insert and said riser pipe;

replacing the drilling fluid in said annulus with a gas; and continue drilling operations through said casing sleeve insert and said wellhead and said first string of casing.

* * * * *